US009462373B2

(12) United States Patent
Kulomäki et al.

(10) Patent No.: US 9,462,373 B2
(45) Date of Patent: Oct. 4, 2016

(54) LOUDSPEAKER AND MANUFACTURING METHOD THEREOF

(71) Applicant: GENELEC OY, Iisalmi (FI)

(72) Inventors: Markku Kulomäki, Iisalmi (FI); Siamäk Naghian, Iisalmi (FI); Jussi Väisänen, Iisalmi (FI); Ilpo Martikainen, Iisalmi (FI); Harri Koskinen, Iisalmi (FI)

(73) Assignee: Genelec Oy, Iisalmi (FI)

( * ) Notice: Subject to any disclaimer, the term of this patent is extended or adjusted under 35 U.S.C. 154(b) by 70 days.

(21) Appl. No.: 14/390,355

(22) PCT Filed: Apr. 2, 2013

(86) PCT No.: PCT/FI2013/050355
§ 371 (c)(1),
(2) Date: Oct. 2, 2014

(87) PCT Pub. No.: WO2013/150182
PCT Pub. Date: Oct. 10, 2013

(65) Prior Publication Data

US 2015/0139466 A1 May 21, 2015

(30) Foreign Application Priority Data

Apr. 2, 2012 (FI) ..... 20125374

(51) Int. Cl.
*H04R 1/20* (2006.01)
*H04R 1/28* (2006.01)
*H04R 1/02* (2006.01)

(52) U.S. Cl.
CPC ..... *H04R 1/2826* (2013.01); *H04R 1/02* (2013.01); *H04R 1/2819* (2013.01); *H04R 1/025* (2013.01); *H04R 1/026* (2013.01)

(58) Field of Classification Search
CPC .... H04R 1/021; H04R 1/2811; H04R 1/023; H04R 1/02; H04R 1/026; H04R 5/02; G10K 11/16; G10K 11/02
USPC ..... 381/345; 181/148, 198, 199
See application file for complete search history.

(56) References Cited

U.S. PATENT DOCUMENTS 4,146,745 A * 3/1979 Froeschle ..... H04R 1/2819 181/145
5,073,937 A 12/1991 Almasy
(Continued)

FOREIGN PATENT DOCUMENTS

| | | | |
|---|---|---|---|
| JP | 2000 078681 | A | 3/2000 |
| JP | 2001 157286 | A | 6/2001 |
| JP | 2002 271880 | A | 9/2002 |
| WO | 2007039671 | A1 | 4/2007 |

OTHER PUBLICATIONS

Hiraga, Jean "Les haut-parleurs", in: "Les haut-parleurs", Nov. 2, 2000, Dunod, Paris, XP055075636, p. 258, Jensen bass reflex housing with double port and absorbing material; p. 258; figure 251.
Hiraga, Jean "Les haut-parleurs", in: "Les haut-parleurs", Nov. 2, 2000, Dunod, Paris, XP055075637, p. 294, top left drawing; p. 294; figure 289.
(Continued)

*Primary Examiner* — Brian Ensey
(74) *Attorney, Agent, or Firm* — Chernoff, Vilhauer, McClung & Stenzel, LLP

(57) ABSTRACT

The present invention provides an improved loudspeaker enclosure comprising two opposing end sections arranged at a distance from each other and enclosing sections which connect the end sections over said distance, wherein the inner volume of the enclosure is defined by said sections. The enclosure also has a reflex port which comprises a reflex opening which is provided to the enclosure and adapted to exhaust internal pressure from the inner volume to outside the enclosure. The reflex port further comprises an inner reflex port former which connects the inner volume of the enclosure to the reflex opening for forming the reflex port. The reflex port former is formed by molding as an integral inner wall section which extends inwards from the inner surface of either or both end section. On the other hand the reflex port former extends adjacent to an enclosing section which at least partially surrounds the reflex port former such that the reflex port is formed to a space between the reflex port former and the adjacent enclosing section.

21 Claims, 7 Drawing Sheets

(56) References Cited

U.S. PATENT DOCUMENTS

Figure 1:
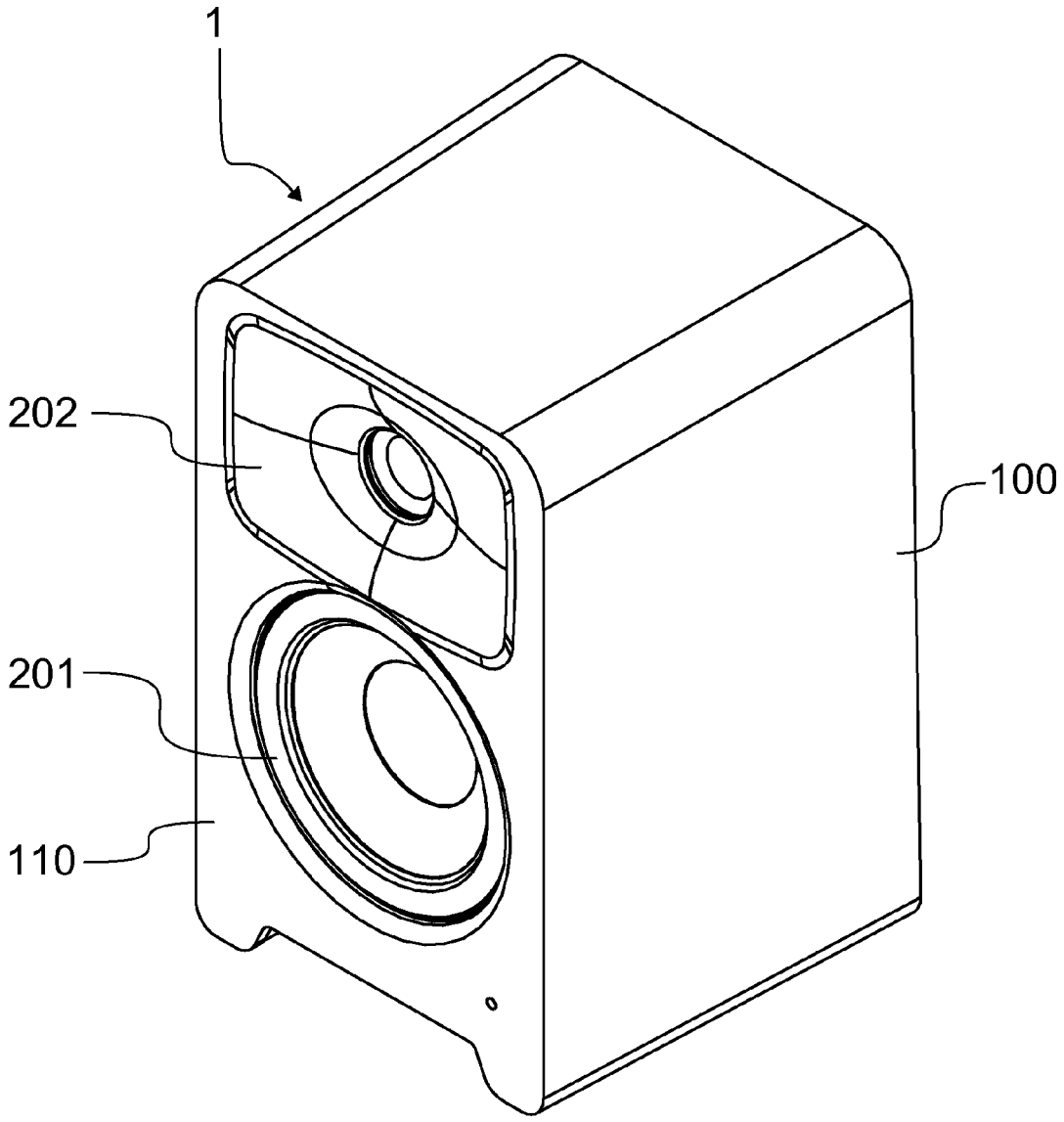

| | | | | |
|---|---|---|---|---|
| 2001/0037910 | A1* | 11/2001 | Coffin | H04R 1/02 181/199 |
| 2004/0104069 | A1 | 6/2004 | Martikainen | |
| 2009/0173567 | A1* | 7/2009 | Stiles | H04R 1/2826 181/199 |
| 2009/0268934 | A1 | 10/2009 | Martikainen | |

OTHER PUBLICATIONS

Finnish Search Report from Application No. 20125374 dated Mar. 22, 2013, 1 pg.

International Search Report, PCT International Application No. PCT/FI2013/050355, Genelec Oy, mailed Aug. 30, 2013, 4 pgs.

* cited by examiner

LOUDSPEAKER AND MANUFACTURING METHOD THEREOF

CROSS-REFERENCE TO RELATED APPLICATIONS

This is a national stage application filed under 35 USC 371 based on International Application No. PCT/FI2013/050355 filed Apr. 2, 2013, and claims priority under 35 USC 119 of Finnish Patent Application No. 20125374 filed Apr. 2, 2012.

BACKGROUND

The present disclosure relates to loudspeakers. In particular, the disclosure relates to injection molded loudspeaker enclosures.

Loudspeaker enclosures are typically somewhat prismatic chambers provided with openings for receiving drivers. Most commercial loudspeaker enclosures can be divided into two main categories: junction structures and molded structures. Junction structures are typically assembled from laminar wall sections that form a prismatic loudspeaker enclosure. The front panel forms a mounting portion of the loudspeaker to which portion the drivers are attached. The panels of junction structure loudspeakers are typically made of natural wood or wood materials such as MDF, which comprises wood fibers combined with wax and a resin binder. Other materials are also known.

However, junction structures are limited to prismatic shapes without extensive manufacturing efforts to create arched shapes. Furthermore, junction structures require a considerable number of assembly steps to complete an enclosure. In most cases, junction structures also require additional enforcement members for establishing sufficient rigidity.

Accordingly, molded structures have been developed for establishing a rigid enclosure with fewer parts. Molded structures typically feature an enclosing mounting portion, which has a front section and integral side, bottom, and top sections extending rearward from the front section. The mounting portion therefore defines a volume that forms part of the inner volume of the loudspeaker. A molded structure also comprises a supplementary portion, which is attached to the rear end of the mounting portion for closing the loudspeaker enclosure. The supplementary portion may be a flat panel but it may also be shaped to define a volume that that forms a part of the inner volume of the loudspeaker when the two portions are assembled. The supplementary portion is typically provided with terminals for the loudspeaker cables as well as heat sink protrusions for cooling the enclosure in active loudspeaker applications. Indeed, molded structure enclosures are common in active loudspeakers as it is convenient to shape the enclosure to conduct heat away from the embedded amplifier. Pressure casted aluminum and alloys thereof are considered as preferred materials in the field of molded structure loudspeaker enclosures due to strength and heat conductivity of aluminiferous materials.

Conventional molded loudspeaker enclosure structures are usually provided with reflex ports in subsequent manufacturing steps. Reflex ports are formed, for example, by forming a hole to the back plate of the loudspeaker and attaching a tubular member to the hole extending inward for exhausting internal pressure shocks and for extending the response curve in low frequencies. It has been considered preferable to direct the reflex port emissions away from the sound fronts emanating from the drivers of the loudspeaker.

Accordingly, reflex ports are designed to open to the rear of the loudspeaker, which yields several benefits compared to front baffle installations. The front baffle is usually designed to be as small as possible for aesthetic reasons but also because the area is needed for drivers. It is therefore beneficial to place the port somewhere other than the front baffle. Placing the reflex port at the front baffle would create a hole close to the sound sources, i.e. drivers, thus forming an acoustical discontinuity which would cause diffraction. Furthermore all tubes have a half wave resonance. Placing the port near the drivers maximizes the excitation of the tube resonance. For high sound pressure levels, the high air velocity in the port causes wide spectrum noise caused by turbulence of the air. It is beneficial to direct the noise source away from the listener.

Because reflex ports require subsequent manufacturing steps, attempts have been made to manufacture them as an integral part of the baffle portion of a molded loudspeaker. In known structures, the reflex port opens to the front of the loudspeaker, which is not especially advantageous for reasons explained above.

SUMMARY

Disclosed is a novel loudspeaker enclosure comprising two opposing end sections arranged at a distance from each other and enclosing sections which connect the end sections over that distance, wherein the inner volume of the enclosure is defined by the sections. The enclosure also has a reflex port that comprises a reflex opening provided to the enclosure and is adapted to exhaust internal pressure from the inner volume to outside the enclosure. The reflex port further comprises an inner reflex port former connecting the inner volume of the enclosure to the reflex opening for forming the reflex port. The reflex port former is formed by molding as an integral inner wall section which extends inwards from the inner surface of either or both end section. On the other hand, the reflex port former extends adjacent to an enclosing section that at least partially surrounds the reflex port former such that the reflex port is formed to a space between the reflex port former and the adjacent enclosing section.

Also disclosed is a novel method for manufacturing a baffle portion for a loudspeaker. In the novel method, a mounting section for receiving a driver is formed by molding a frontal wall section. In the same manufacturing step, enclosing sections are formed by integrally molding rearward extending and interconnected wall sections to the mounting section such that the enclosing sections protrude rearward from the inner surface of the mounting section and define therebetween a volume, which forms at least part of the inner volume of the loudspeaker. A reflex port is further formed in the same manufacturing step by molding an integral reflex port former as an inner wall section which extends from the inner surface of the mounting section rearward as a substantially parallel protrusion to the side enclosing sections. Accordingly, the reflex port, which is formed to a space between the reflex port former and an adjacent enclosing section, opens to the outside of the baffle portion and away from the mounting section.

Considerable benefits may be gained using the teachings of the present disclosure. Because the reflex port is formed during the molding of portion of the loudspeaker enclosure, no subsequent manufacturing steps are required. Simultaneously, the reflex port may also be directed to open away from the drivers removing the above explained disadvantages caused by exhausting reflex pressure in front of the loudspeaker.

With the novel construction and method, it is possible to produce a reflex port that is curved, wherein the port may have a dimensioned long length, which helps the acoustics of the loudspeaker. Moreover, the construction provides improved sound reproduction in low frequencies, as the reflex port may be dimensioned with a length sufficient to significantly extend the response curve.

The novel design yields yet another benefit in that the reflex port former protruding from the end section of the enclosure acts as an auxiliary stiffening bar that makes the enclosure more rigid, further improving sound characteristics of a molded loudspeaker enclosure.

The foregoing and other objectives, features, and advantages of the disclosure will be more readily understood upon consideration of the following detailed description of the invention taken in conjunction with the accompanying drawings.

BRIEF DESCRIPTION OF THE SEVERAL DRAWINGS

In the following, certain embodiments are described in greater detail with reference to the accompanying drawings, in which:

FIG. 1 presents a front elevation view of a loudspeaker comprising a baffle portion of a loudspeaker enclosure according to one embodiment.

Figure 2:
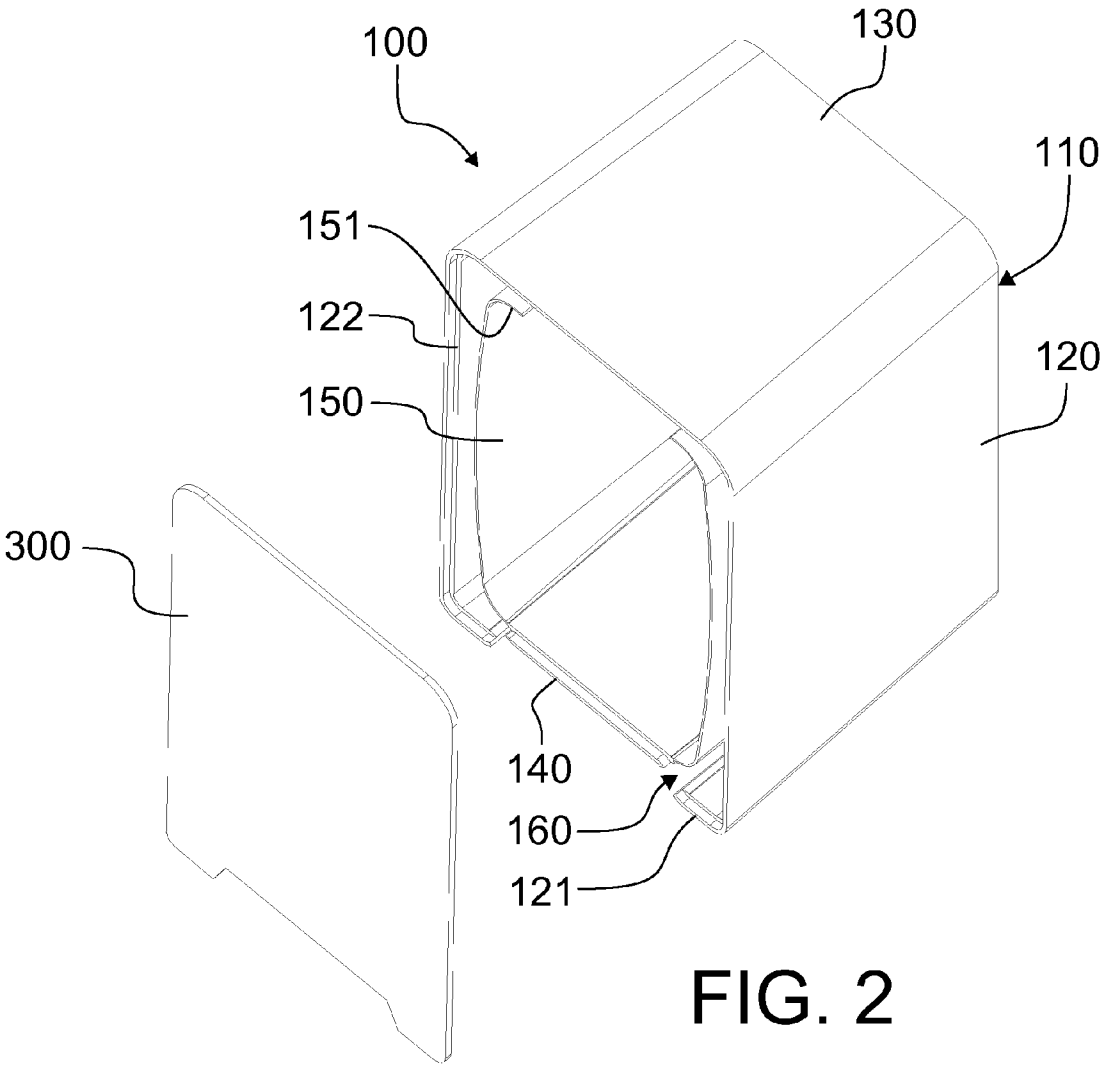

FIG. 2 presents a rear elevation view of the loudspeaker of FIG. 1 with a removed back wall section.

Figure 3:
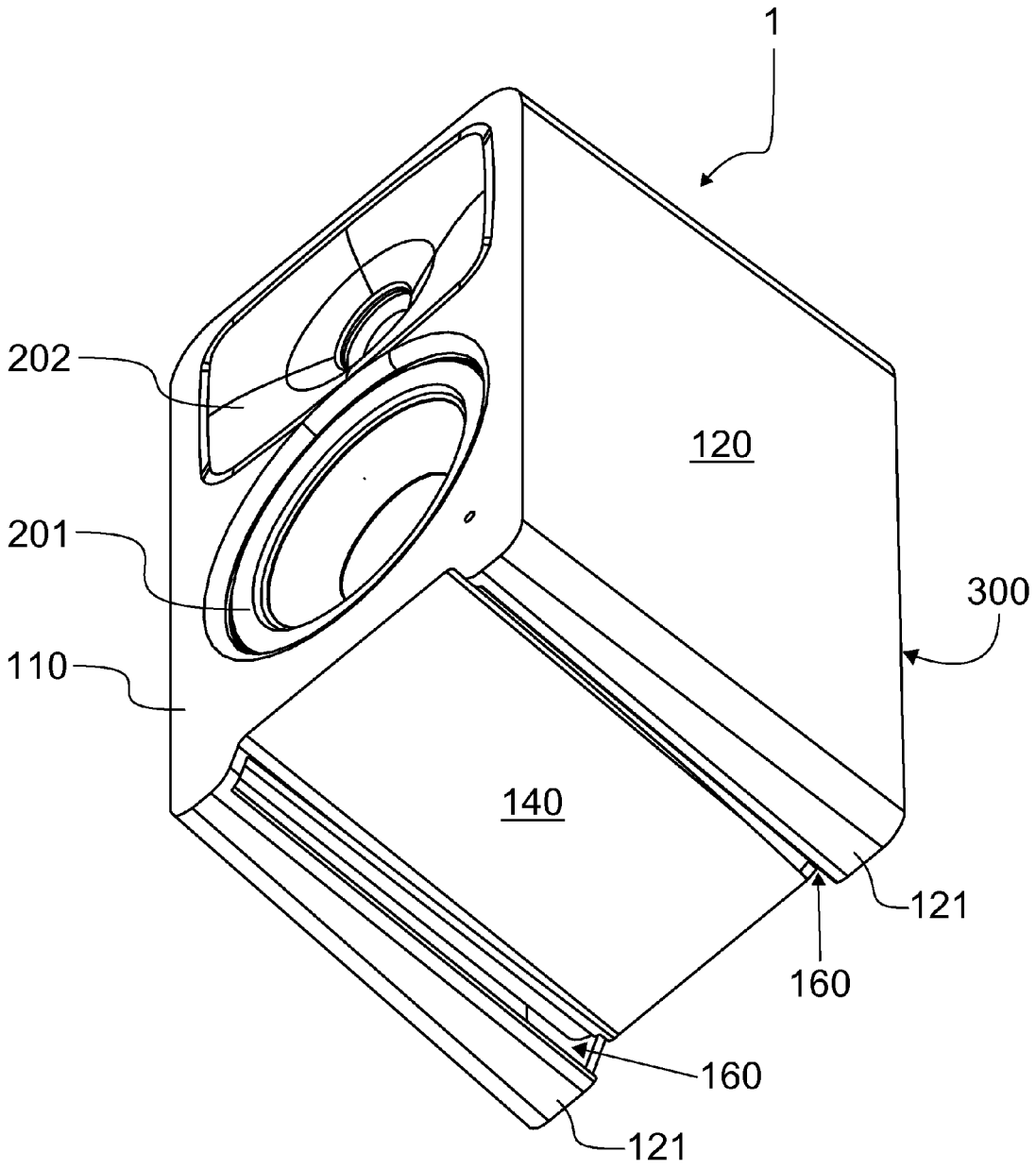

FIG. 3 presents a bottom view of the loudspeaker of FIG. 1.

Figure 4:
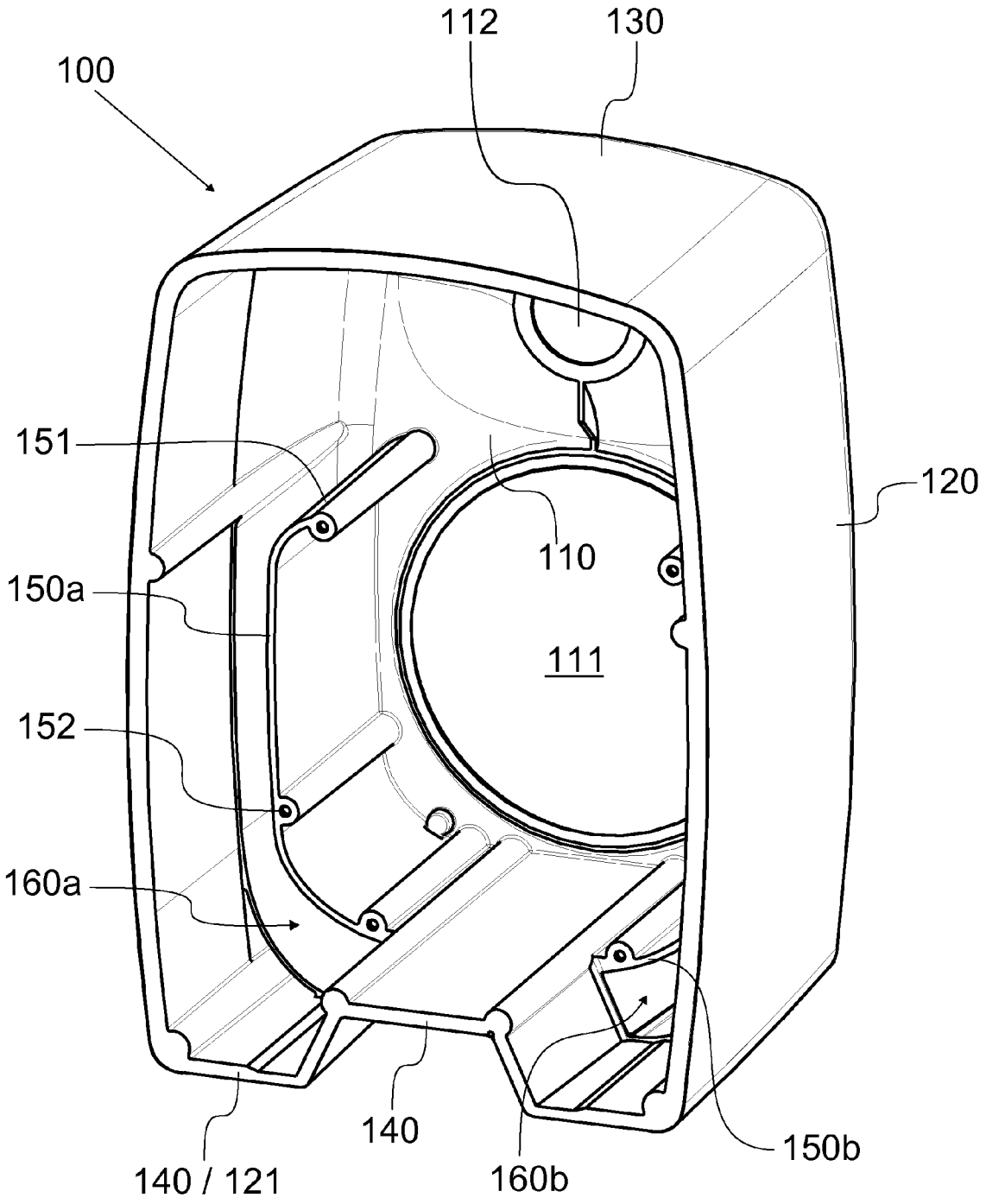

FIG. 4 presents an upper rear isometric view of a baffle portion of a loudspeaker enclosure according to another embodiment.

Figure 5:
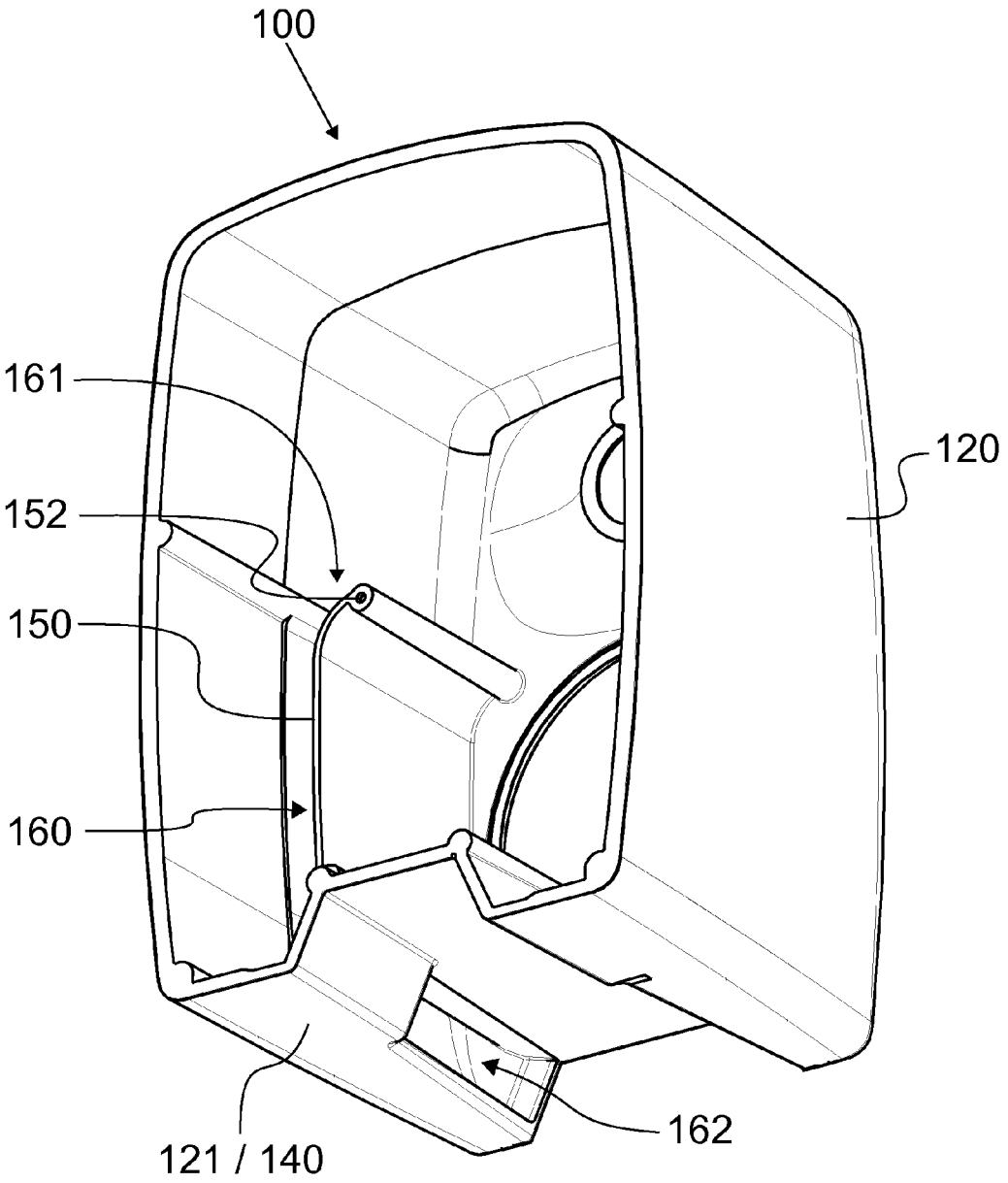

FIG. 5 presents a lower rear isometric view of the baffle portion of FIG. 4.

Figure 6:
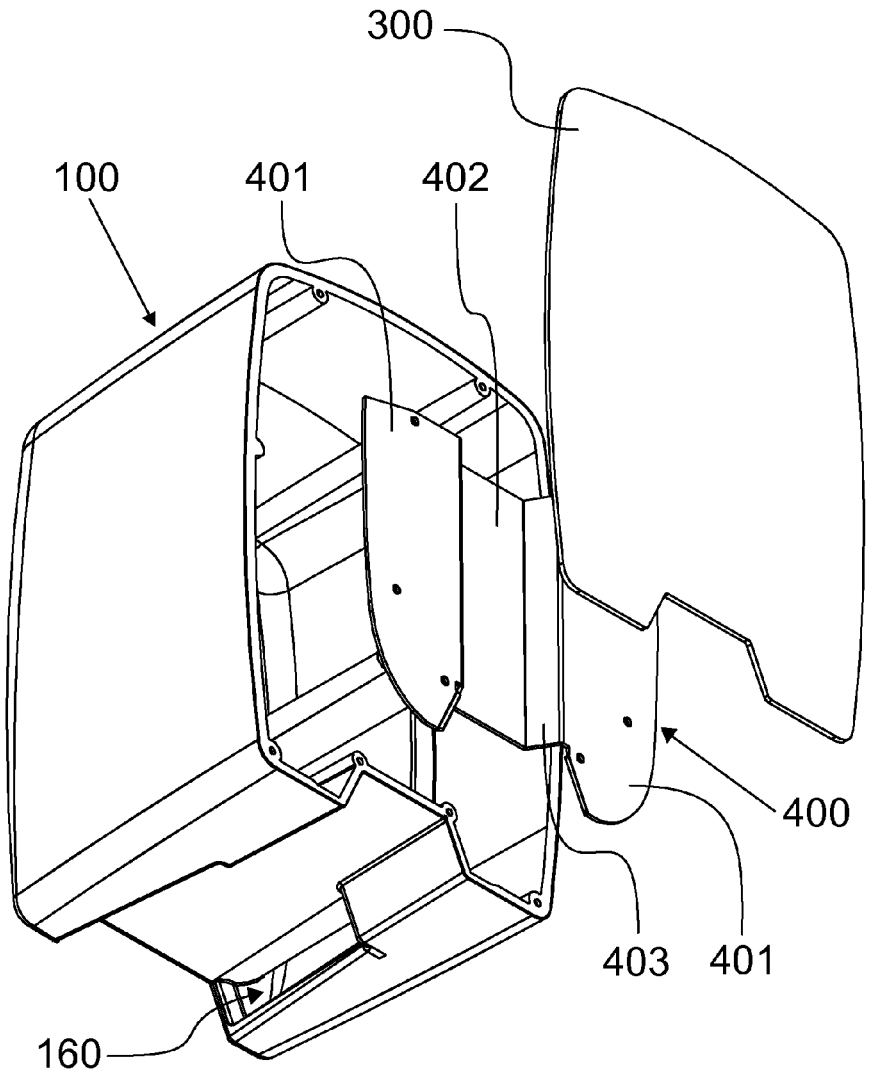
Figure 7:
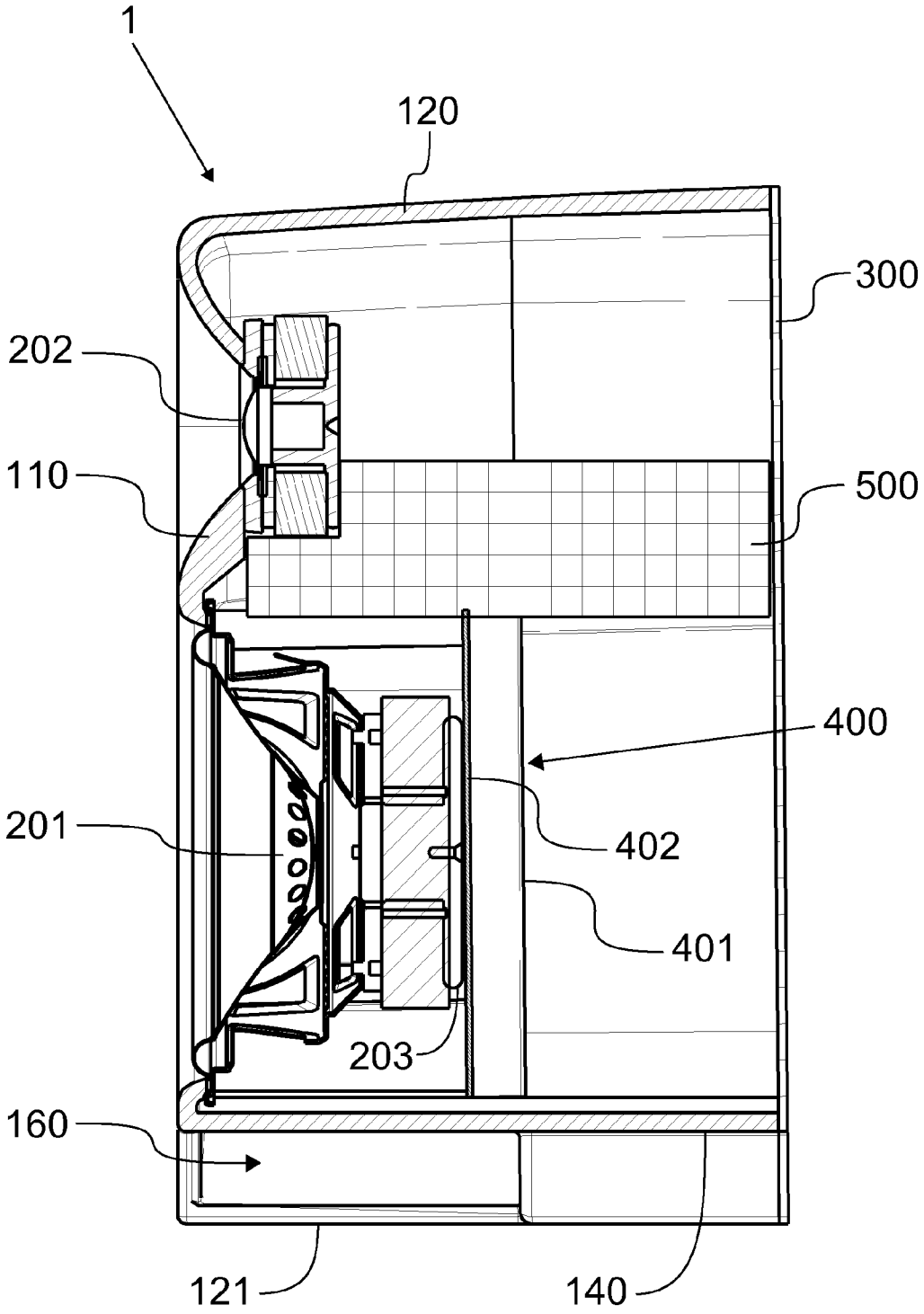

FIG. 6 presents a lower rear isometric explosion view of the baffle portion of FIG. 4 together with a terminating plate and a closing section, and FIG. 7 presents a cross-sectional view of a loudspeaker assembly comprising the loud-speaker enclosure of FIG. 6.

DETAILED DESCRIPTION

In this context the term forward direction refers to the direction to which sound waves primarily radiate from the speaker. Conversely, the term rearward direction refers to the opposite of forward direction. Respectively, the terms front and rear represent the sides of the speaker that are in the direction of forward or rearward directions, whereas sides are orthogonal to the front and rear faces of the enclosure. Furthermore, the term axial is used herein to describe the dimension in which the sound waves radiate either forward or rearward.

The baffle portion 100 according to one embodiment of the invention extends backward such that it forms at least part of the total inner volume of the loudspeaker 1, e.g., at least 50 percent. In the embodiment presented in the appended figures, the baffle portion 100 encloses the entire inner volume of the loudspeaker 1, whereby the loudspeaker 1 is closed by a planar closing section 300. A bordering ridge 122 has been provided to the rear of the enclosing portions for creating an embedding for a rear plate 300 for closing the baffle portion 100 and forming the loudspeaker 1. The closing section 300 may also form part of the inner volume, whereby the rear plate would be provided with forward-extending wall sections (not shown), which enclose an inner volume and which engage with respective wall sections of the baffle portion 100.

The baffle portion 100 comprises a mounting section 110, which is provided with an opening for receiving a driver 200. The mounting section 110 is in the illustrated embodiment provided to the front end of the baffle portion 100 and has two openings for forming a two-way loudspeaker. While the disclosure is explained and illustrated in the drawings as a two-way loudspeaker embodiment, the disclosure is also applicable to loudspeaker enclosures designed for only one driver, a coaxial driver, or any other setup comprising at least one driver. Accordingly in FIGS. 1 to 3, the first opening is provided with a mid-frequency driver 201 and the second opening is provided with a high-frequency driver 202. The baffle portion 100 is made by molding, such as by injection molding. Accordingly, the baffle portion 100 is an integral piece having a frontal wall section and lateral wall sections extending backward from the frontal wall section. In particular, enclosing sections 120, 130, and 140 are integrally formed to the mounting section 110 such that said sections 110, 120, 130, and 140, enclose the inner volume of the loudspeaker 1 or at least a portion thereof. The enclosing sections include enclosing top and bottom sections 130 and 140, which extend rearward from the mounting section 110. The substantially parallel top and bottom sections 130 and 140 are spaced-apart to create a height for the loudspeaker 1. The enclosing sections further include two mutually and substantially parallel side sections 120 which extend rearward from the mounting section 110 and are spaced apart to create a width for the loudspeaker 1. When viewed from the top enclosing section 130 of the baffle portion 100, the enclosing side sections 120 extend beyond the enclosing bottom section 140 and are bent toward each other. Resulting bottom extensions 121 of the enclosing side sections 120 create stands for providing a gap between the bottom section 140 and the platform on which the loudspeaker 1 is to be placed. The bottom extensions 121 are therefore flat and wide enough to provide sufficient support.

As can be seen from FIG. 2, the baffle portion 100 comprises an inner reflex port former 150, which is formed integrally by molding as an inner wall section that extends from the mounting section 110 rearward to the inside thereof. The reflex port former 150 is formed similarly to the enclosing sections 120, 130, and 140, which extend rearward from the inner surface of the frontal mounting section 110. Accordingly the reflex port former 150 is molded as a substantially parallel protrusion to the side enclosing sections 120 at a distance on the inside thereof. Accordingly, the reflex port former 150 forms a reflex port 160 that opens to the outside of the baffle portion 100 and away from the mounting section 110. The reflex port 160 is therefore formed to a space between the reflex port former 150 and an adjacent enclosing section 120. It would be possible to provide another parallel reflex port former (not shown) between the reflex port former 150 and the side enclosing section 120, wherein the reflex port 160 would be formed between the two reflex port formers. The reflex port 160 would however in any case be formed to the space between the reflex port former 150 and the adjacent enclosing section with or without an extra reflex port former.

In the illustrated embodiment, the baffle portion 100 comprises two reflex port formers 150, which form two respective reflex ports 160. The driver opening in the mounting section 110 has a plane that has a normal axis. The inner reflex port formers 150 are shaped to at least partially surround the normal axis of the driver opening. This results in curved reflex ports 160, which follow the inner surface of the side enclosing sections 120 and surround the rear part, i.e. the inner components such as magnets, of the drivers 201, 202. The curvature of the reflex ports 160 is further amplified by starting camber 151 in the free top end of the reflex port former 150. The reflex port former 150 terminates to another camber at the other end thereof where the former 150 merges to the bottom enclosing section 140. The reflex ports 160 thus open to the outside of the loudspeaker 1. As described above, bottom extensions 121 of the enclosing side sections 120 create stands, which provide a gap between the bottom section 140 and the platform on which the loudspeaker 1 is to be placed. Accordingly, the reflex port 160 opens, i.e. terminates, to the gap. In other words, the reflex ports 160 open to the inner flanks of the stands formed by vertical overhangs of the side enclosing sections 120. More precisely the reflex port formers 150 terminate to the inner surface of the bottom enclosing section 140, whereby the reflex port 160 terminates to a slit between the extension 121 of an enclosing side section 120 and the bottom enclosing section 140 (FIG. 3).

As mentioned above, the loudspeaker enclosure 1 according to the present disclosure may also be established in manner deviating from the construction illustrated in FIGS. 1 to 3. For example, according to one embodiment, the rear portion of the enclosure may also form part of the inner volume, whereby the rear plate would be provided with forward-extending wall sections (not shown), which enclose an inner volume and which engage with respective wall sections of the baffle portion 100. In such an embodiment (not shown) a supplementary portion is formed, whereby the enclosure 1 has two opposing portions: a baffle portion 100 and a supplementary portion. The baffle portion may be similar to that described above. The supplementary portion would therefore also be made by molding, such as by injection molding. By contrast to a mere planar back plate, the supplementary portion according to the embodiment not shown comprises a closing section as described, but which comprises integral lateral wall sections extending forward therefrom. In particular, enclosing sections are integrally formed to the closing section such that the sections enclose an inner volume of the loudspeaker enclosure 1 or at least a portion thereof. The enclosing sections correspond to those explained above. The supplementary portion also comprises a reflex port former, which is an integral extension of the closing section opposing the mounting section. The reflex port former therefore protrudes inwards from the closing section, i.e. forward.

The supplementary portion may form a portion of the inner volume of the loud-speaker enclosure, whereby the baffle portion forms the remaining portion of the inner volume. It is also possible to form the entire inner volume with the supplementary portion, whereby the baffle portion consists of a front plate. According to one embodiment, the baffle portion and the supplementary portion each form about 50 percent of the inner volume of the enclosure. In some embodiments, where both portions define the inner volume of the enclosure, the reflex port is formed by two mating reflex port formers, wherein one reflex port former is provided to the mounting section and the other is provided to the closing section. The mating reflex port formers are designed to engage such that the reflex port is formed through a tight enough joint to prevent pressure shocks from escaping the reflex port through the interface of the mating reflex port formers.

As mentioned above, the baffle portion 100 is made by molding, injection molding. The enclosing sections 120, 130, and 140 as well as the reflex port former 150 are formed by feeding material into the mold through the mounting section 110, wherein the enclosing sections 120, 130, and 140 and the reflex port former 150 protrude from the mounting section 110 to the inside of the baffle portion 110. The feeding gate is therefore provided to the mounting section 110 in the molding process. As a result, the sections of the baffle portion 100 are integral parts of the piece rather than individual components thereof. It is therefore particularly possible to favor roundings between the enclosing sections 120 and 130 as well as in the extensions 121. Furthermore, the substantially parallel side enclosing sections 120 as well as top and bottom sections 130 and 140 are slightly angled for promoting the ejection of the baffle portion 100 from the mold. The baffle portion 100 may be made of any material suitable for injection molding. However, it is particularly possible to use a composite material comprising thermo wood powder or pulp and polymer, reducing the need for finishing steps in the manufacturing process since such a material makes it possible to achieve adequate surface quality directly in the mold.

It is also possible to use other materials or composites in addition to, or instead of, the materials presented above. For example, it is possible to exploit composites having a combination of gypsum or talc, and polymer. Alternatively, potstone, cellulose, thermo wood and glass fiber may be used as a combination as such or combined with materials listed above.

FIGS. 4 to 7 show a further embodiment where reflex ports 160 are formed to respective spaces that are defined by a reflex port former 150, an enclosing side section 120 and a terminating plate 400. The reflex port formers 150 preferably extend rearwards from the inner surface of the mounting section 110 to about half-way along the axial direction of the baffle portion 100. The baffle portion 100 forms substantially the entire axial reach of the enclosure 1, whereas the closing section 300 is a mere back plate. Alternatively, it could be possible to construct a similar terminating plate arrangement such that the enclosure 1 would comprise two axially extending halves, wherein the mounting section 100 together with the reflex port formers 150 would extend to about half-way along the axial dimension of the enclosure 1, and the closing section 300 would feature a corresponding axial reach, i.e. corresponding enclosing side, bottom and top sections 120, 130, 140 (not shown). Also other axial proportions are possible.

The reflex ports 160 are therefore in the illustrated embodiment not closed by the closing section 300 but by the terminating plate 400, which is parallel to the closing section 300 and arranged within the enclosure 1 to close the reflex ports 160 in the axial direction. The reflex port openings are provided to the bottom of the enclosure as in the embodiment of FIG. 2. The terminating plate 400 enables adjustment of the volume of the reflex port 160 by limiting its axial length while maintaining the overall inner volume of the enclosure. This yields the benefit of being able to use one baffle portion design for a variety of different diaphragms that can be adapted to the enclosure by fine tuning the reflex port with aid of said terminating plate.

FIG. 4 shows the structure of the reflex port former 150 without the terminating plate 400. The illustrated embodiment features two opposing reflex port formers 150*a*, 150*b* arranged adjacent to opposing side sections 120 and thus provides two opposing reflex ports 160*a*, 160*b* that open to the space between the bottom extensions 121 of the opposing enclosing side sections 120. The reflex port former 150 comprises a similar starting camber 151 similar to the first embodiment shown in FIGS. 2 and 4, where the starting camber 151 forms the inner opening for the reflex port 160. FIG. 4 also shows that the reflex port former 150 extends rearwards from the mounting section 110 to approximately the midpoint of the loudspeaker in the axial direction. As the reflex port 160 in this embodiment does not terminate to the closing section (not shown in FIG. 4), fixing points 152 have been provided for connecting the terminating plate 400 to the reflex port former 150. The fixing points 152 may take the shape of axial bulges made to the inner surface of the reflex port former 150. As the reflex port former 150 is molded simultaneously with the entire baffle portion 100, so are the fixing points, which is advantageous in the manufacturing process. The fixing points 152 are threaded after molding. Alternatively, screws such as PT screws or self threading screws may be used.

FIG. 5 shows the baffle portion 100 of FIG. 4 from a lower isometric view, and shows in greater detail the outer opening of the reflex port 160. As explained above, the outer opening of the reflex port 160 is formed into the space between opposing bottom extensions 121 of the opposing enclosing side sections 120. In other words, the enclosing bottom section 140 of the loudspeaker enclosure is upwardly recessed for providing integrated stands and creating clearance for the outer openings of the reflex ports 160. Because the baffle portion 100 is created as one integral piece, distinguishing between different sections is a matter of semantics. Indeed, the enclosing sections 120, 130, 140 form a continuous enclosure profile (cf. FIG. 6), wherein there is a central upper recess in the bottom section 140, and openings provided to the upward extending flanks of the bottom section 140 create the outer opening of the reflex port 160. FIG. 5 also shows similar bulges to those on the reflex port formers 150 formed to the inner surfaces of the side enclosing sections 120 for fixing the closing section 300 to the baffle portion 100.

FIG. 6 shows the structure of the terminating plate 400. The terminating plate 400 is adapted to be fixed to the fixing points 152 of the reflex port former 150. The terminating plate 400 therefore may have been provided with through-holes that accommodate screws. Also, the terminating plate 400 has been dimensioned such that it fits tightly between the opposing side sections 120 of the baffle portion 100 for avoiding leaks in the reflex port 160. Once installed, the terminating plate 400 together with the enclosing side sections 120 and reflex port formers 150 define the profile of the reflex port 160. As can be further seen from FIG. 6, the terminating plate comprises two aligned flat rear flange portions 401 and a front portion 402 in front of the rear flange portions 401 as well as two corresponding beveled connecting portions 403 connecting the front portion 402 to the rear flange portions 401. The terminating plate 400 is fixed to the reflex port former 150 from the rear flange portions 401, whereas the connecting portions 403 provide frontal extension such that the front portion 402 engages with the driver 201 arranged between the reflex port formers 150.

According to an alternative embodiment, the terminating plate 400 is substantially planar.

The assembly of the loudspeaker enclosure 1 is illustrated in the cross-sectional view of FIG. 7. As illustrated, the mounting section 110 accommodates a high-frequency driver 202 and a low-frequency driver 201, which is secured to the enclosure by the terminating plate 400. More specifically, the low-frequency driver 201 is attached to the inner surface of the opening in the mounting section during assembly, when the terminating plate 400 is fixed to the reflex port formers 150. The front portion 402 of the terminating plate 400 pushes the magnet of the low-frequency driver 201 forwards. An assembly spring 203 may be used between the low-frequency driver 201 and front portion 402 of the terminating plate 400 to ensure tight positioning. Also, depending on compliance of the spring, there may be a further effect of removing the resonance caused by the combination of basket and magnet. FIG. 7 also shows how the rear flange portion 401 of the terminating plate 400 is aligned with the rear end of the outer opening of the reflex port 160. When used to support a driver, the terminating plate 400 is perforated (not shown) for allowing rearward impulses created by the driver diaphragm to flow through the plate 400 such that the plate 400 induces minimal reflections or pressure peaks. The perforation also prevents division of the internal volume of the enclosure, which eliminates unwanted reflections or resonances or both.

The terminating plate 400 may be used for achieving further benefits. As can be seen from FIG. 4, the plate may be used to secure the low-frequency driver 201 to the mounting section from the inside of the enclosure. By dimensioning the driver 201, the axial length of the reflex port formers 150 and the plate, as well as possible additional spacers (not shown), the driver 201 is simultaneously locked into place when the plate is fixed to the baffle portion 100 during assembly. Accordingly, no fixing means are visible to the outside of the enclosure and there is one less assembly stage compared to conventional assembly.

The terminating plate may also act as a fixing point for absorption material 500, such as polyester or glass wool, which is used to eliminate reflections within the enclosure that could cause coloration to the sound. The optimal placement for absorption material is at and below the horizontal plane of the port openings 151 inside the enclosure, as is the case in the example of FIG. 7, wherein the terminating plate 400 is used for supporting the absorption material. Placing absorption above the port opening 151 horizontal plane would add damping to the air flow of the port. Therefore the beneficial gain of the Helmholtz resonance would be reduced. Placing the absorption at the bottom of the enclosure is not efficient because the particle velocity maxima of the first order internal modes in enclosure volume are at the center of the volume. An additional benefit of having the absorption material at the terminal of the port opening is the added damping of the air column resonance formed between the two port openings.

According to a further embodiment (not shown), the driver 201 and terminating plate 400 are both locked into place during assembly by an axial extension of the closing section 300. In this embodiment, the driver 201 and terminating plate 400 are assembled into place without additional fixing means, whereby the axial extension of the closing section pushes the terminating plate 400 and therefore also pushes the driver 201 forward into correct position. It is therefore possible to assemble three components by using only one set of fixing means, such as screws, to attach the closing section 300 to the baffle portion 100.

The terms and expressions that have been employed in the foregoing specification are used therein as terms of description and not of limitation, and there is no intention in the use of such terms and expressions of excluding equivalents of the features shown and described or portions thereof, it being recognized that the scope of the claimed subject matter is defined and limited only by the claims that follow.

The invention claimed is:

1. A loudspeaker enclosure comprising:

end sections arranged at a distance from each other;

enclosing sections connecting the end sections over said distance, wherein the volume enclosed by the enclosure is defined at least in part by said sections, and a reflex port comprising a reflex opening that provides an opening being provided to the enclosure and capable of exhausting internal pressure from the enclosure, where the opening is provided to a mounting section, which is one of the end sections, and a molded inner reflex port former which forms an inner wall section that connects the enclosure to the reflex opening for forming the reflex port, where the reflex port former is an integral extension of the mounting section and where the reflex port opens away from the mounting section, and where the reflex port forms an inner wall section being integral to at least either end section and extends inwards from the inner surface of at least one end section and adjacent to an enclosing section, which at least partially surrounds the reflex port former such that the reflex port is formed to a space between the reflex port former and the adjacent enclosing section; wherein, a driver opening in the mounting section has a plane with a normal axis, wherein the inner reflex port former extends inwards from the mounting section and is shaped to at least partially surround the normal axis of said driver opening, and wherein a curved reflex port opening to the outside of the loudspeaker is formed to a space between the reflex port former and an adjacent enclosing section.

2. The loudspeaker enclosure according to claim 1, wherein enclosing sections are integrally formed to the mounting section such that said sections enclose at least a portion of the inner volume of the loudspeaker, wherein the enclosing sections and the reflex port former protrude inwards from the mounting section.

3. The loudspeaker enclosure according to claim 2, wherein the mounting section and the enclosing sections form a baffle portion which defines at least 50 percent of the inner volume of the loudspeaker enclosure.

4. The loudspeaker enclosure according to claim 3, wherein the baffle portion comprises:

an enclosing bottom section extending rearward from the mounting section, an enclosing top section extending rearward from the mounting section and opposing the enclosing bottom section, and two enclosing side sections which extend rearward from the mounting section and which are spaced apart to create a width for the loudspeaker and which also extend from the top section beyond the enclosing bottom section and toward it such that the bottom extensions of enclosing side sections create stands for providing a gap between the bottom section and the platform on which the loudspeaker is to be placed.

5. The loudspeaker enclosure according to claim 4, wherein the reflex port former terminates to the inner surface of the bottom enclosing section, whereby the reflex port terminates to a slit between the extension of an enclosing side section and the bottom enclosing section.

6. The loudspeaker enclosure according to claim 1, wherein the loudspeaker enclosure comprises two opposing reflex port formers for forming two reflex ports such that a reflex port former is arranged adjacent to two opposing enclosing sections.

7. The loudspeaker enclosure according to claim 1, wherein a bottom one of the enclosing sections, extends rearward from another end section which is configured to receive a driver, a top one of the enclosing sections extends rearward from the mounting section and opposes the enclosing bottom section, and a plurality of enclosing side sections that extend rearward from the mounting section and are spaced apart to create a width for the loudspeaker, which enclosing side sections also extend from the top one of the enclosing sections and beyond the bottom one of the enclosing sections such that bottom extensions of enclosing side sections form stands that provide a gap between the bottom one of the enclosing sections and any platform on which the loudspeaker is placed.

8. The loudspeaker enclosure according to claim 7, wherein the reflex port former terminates to the inner surface of the bottom one of the enclosing sections, whereby the reflex port terminates to a slit between the extension of an enclosing side section and the bottom one of the enclosing sections.

9. The loudspeaker enclosure according to claim 7, wherein the reflex port former extends over a portion of the axial dimension of the loud-speaker enclosure, wherein the reflex port is terminated in axial direction by a terminating plate provided to inside the enclosure such that the reflex port is formed to a space defined by a reflex port former, an enclosing side section and the terminating plate.

10. The loudspeaker enclosure according to claim 9, wherein the enclosure comprises two opposing reflex port formers which surround the inner portion of a driver, wherein the terminating plate connecting the reflex port formers also secures the driver to the enclosure.

11. The loudspeaker enclosure according to claim 9, wherein the terminating plate is perforated.

12. The loudspeaker enclosure according to claim 9, where absorption material is arranged at the horizontal plane of the reflex port openings inside the enclosure.

13. The loudspeaker enclosure according to claim 1, wherein the reflex port former is an integral extension of an end section opposing the mounting section.

14. The loudspeaker enclosure according to claim 13, wherein the reflex port is formed by two mating reflex port formers one of which being provided to the mounting section and the other being provided to the end section opposing the mounting section.

15. The loudspeaker enclosure according to claim 13, wherein the end section opposing the mounting section is the closing section at the rear of the loudspeaker enclosure.

16. The loudspeaker enclosure according to claim 1, wherein a bordering ridge has been provided at the rear of the enclosing sections for creating an embedding for a rear plate for closing the baffle portion.

17. The loudspeaker enclosure according to claim 13, wherein enclosing sections are integrally formed to the closing section such that said sections enclose at least a portion of the volume enclosed by the loudspeaker, wherein the enclosing sections and the reflex port former protrude inwards from the closing section.

18. A method for manufacturing a baffle portion for a loudspeaker said method comprising the steps of:

forming a mounting section for receiving a driver by molding a frontal wall section; and forming enclosing sections by molding rearward extending and interconnected wall sections integrally to the mounting section such that the enclosing sections protrude rearwardly from the inner surface of the mounting section and define therebetween a volume which forms at least part of the inner volume of the loudspeaker, forming a reflex port by molding, integrally with the mounting section, a reflex port former as an inner wall section which extends from the inner surface of the mounting section rearward as a substantially parallel protrusion to the side enclosing sections, whereby the reflex port, which is formed to a space between the reflex port former and an adjacent enclosing section, opens to the outside of the baffle portion and away from the mounting section; and molding a driver receiving opening in the mounting section, the opening having a plane with a normal axis, and shaping the inner reflex port former to extend from the mounting section to the inside of the molded baffle portion and to at least partially surround the normal axis of said driver opening, wherein a curved reflex port opening to the outside of the loudspeaker is formed to a space between the reflex port former and an adjacent enclosing section.

19. The method according to claim 18, including molding two reflex port formers for forming two reflex ports such that a reflex port former is arranged adjacent to both enclosing side portions.

20. The method according to claim 18, including molding the reflex port former to extend over a portion of the axial dimension of the loudspeaker enclosure.

21. The method according to claim 20, including terminating the reflex port in the axial direction of the loudspeaker enclosure by installing a terminating plate to inside the enclosure such that the reflex port is formed to a space defined by a reflex port former, an enclosing side section and the terminating plate.

* * * * *